US011305168B2

(12) United States Patent
Smith

(10) Patent No.: US 11,305,168 B2
(45) Date of Patent: Apr. 19, 2022

(54) SELF-SUPPORTING AND STOWABLE CLIMBING WALL

(71) Applicant: Jeffry W. Smith, Madison, WI (US)

(72) Inventor: Jeffry W. Smith, Madison, WI (US)

(73) Assignee: Jeffry W. Smith, Madison, WI (US)

( * ) Notice: Subject to any disclaimer, the term of this patent is extended or adjusted under 35 U.S.C. 154(b) by 139 days.

(21) Appl. No.: 16/742,023

(22) Filed: Jan. 14, 2020

(65) Prior Publication Data

US 2020/0222778 A1 Jul. 16, 2020

Related U.S. Application Data

(60) Provisional application No. 62/792,121, filed on Jan. 14, 2019.

(51) Int. Cl.
*A63B 69/00* (2006.01)
*A63B 9/00* (2006.01)

(52) U.S. Cl.
CPC ..... *A63B 69/0048* (2013.01); *A63B 9/00* (2013.01); *A63B 2210/50* (2013.01)

(58) Field of Classification Search
CPC .... A63B 69/0048; A63B 9/00; A63B 2210/50
See application file for complete search history.

(56) References Cited

U.S. PATENT DOCUMENTS 6,551,215 B1 * 4/2003 Gordon ..... A63B 69/0048 472/134
6,860,836 B1 * 3/2005 Wu ..... A63B 22/001 198/850
6,872,167 B1 * 3/2005 Meissner ..... B63B 34/00 482/37
9,017,224 B1 * 4/2015 Singley ..... A63B 22/0023 482/52
2002/0169052 A1 * 11/2002 Godsey ..... A63B 69/0048 482/37
2008/0293548 A1 * 11/2008 Moy ..... A63B 69/0048 482/36
2008/0300111 A1 * 12/2008 Meissner ..... A63B 69/0048 482/36
2012/0184177 A1 * 7/2012 Ochi ..... A63B 69/0048 446/227
2018/0229094 A1 * 8/2018 Morse ..... A63B 69/0048
2020/0023257 A1 * 1/2020 Speed ..... A63B 1/00
2021/0101061 A1 * 4/2021 Pell ..... A63B 69/0048

OTHER PUBLICATIONS

Mincing Thoughts, "Kids Climbing Play Structure—Building a Climbing Wall and Cargo Net", Jul. 9, 2015, http://mincingthoughts.blogspot.com/2015/07/kids-climbing-play-structure-building.html (Year: 2015).*

The Rocker Climber's Training Manual, "Adjustable Mount for the RPTC", Apr. 23, 2014, https://rockclimberstrainingmanual.com/2014/04/23/adjustable-mount-for-the-rptc/ (Year: 2014).*

* cited by examiner

*Primary Examiner* — Jennifer Robertson
(74) *Attorney, Agent, or Firm* — Smith Law Office; Jeffry W. Smith

(57) ABSTRACT

A stowable climbing wall device having a self-supporting frame, and a climbing wall first side and a second side releasably joined together for movement between a closed position and an open position, and the climbing wall side includes a removable panel for engaging climbing holds.

21 Claims, 13 Drawing Sheets

SELF-SUPPORTING AND STOWABLE CLIMBING WALL

CROSS REFERENCE TO RELATED APPLICATION

This application claims the benefit of U.S. Provisional Application No. 62/792,121, filed Jan. 14, 2019, the disclosure of which is incorporated by reference herein.

FIELD AND BACKGROUND OF THE INVENTION

This invention relates generally to recreational climbing walls and more specifically to a climbing wall that is self-supporting, and can be readily disassembled, stowed, and reassembled.

Recreational climbing walls simulate a rock climbing experience using climbing holds that are bolted or otherwise secured to a panel or wall to provide necessary support and stability for climbers. The climbing holds are mounted on surfaces that are vertical or at various angles to provide a more realistic climbing experience.

Typically, climbing walls have regularly spaced mounting locations at which the climbing holds can be mounted, but to simulate a rock climbing experience, the holds are mounted at irregular mounting location spacings and rearranged periodically to vary the simulated rock climbing experience. The ability to rearrange the climbing holds obviates the need to rearrange the panels, which are securely and permanently mounted to a wall, ceiling, or other dedicated supporting structure.

Given the permanent nature of climbing wall components and the relatively large space they occupy, they are not suitable for some home environments. Smaller versions for children require less space and have even been mounted onto bunk beds, for example, but the options for play are limited to a permanent and small dedicated space for the climbing wall.

Thus, there is a need for a climbing wall that requires no permanent mounting location and yet provides a safe, challenging, and variable climbing wall experience.

SUMMARY OF THE INVENTION

In accordance with the present invention, there is provided a stowable climbing wall having a self-supporting frame; and a climbing wall panel releasably joined to a first side of the self-supporting frame. The self-supporting frame is preferably moveable between an open position and a closed position for stowage, and reassembly for future use. The self-supporting frame first side can also include: a second climbing wall panel for assembly with the first panel to enlarge the climbing surface, while enabling easier stowage and reduce its size when stowed. A panel locking device can also be used to releasably secure one or more of the climbing wall panels to the self-supporting frame, to prevent inadvertent removal of the panel from the self-supporting frame. Methods for assembling and disassembling the stowable climbing wall are also provided.

The self-supporting frame first side preferably includes a rail, and a self-supporting frame second side includes a second side rail pivotably joined to the first side rail for pivoting movement of the self-supporting frame between an open position and a closed position. The self-supporting frame also preferably includes a frame locking device to releasably secure the self-supporting frame in an open position, and resist inadvertent movement toward the closed position.

The stowable climbing wall can also include a climbing device joined to the second side, such as a second climbing wall, steps, rungs, or other play device.

The frame locking device to maintain the self-supporting frame in an open position can include: a spreader pivotably joined to the self-supporting frame first side and the self-supporting frame second side; and a locking platform fixed to a first portion of the spreader, and releasably joined to a second portion of the spreader. A connector can further be used to releasably join the locking platform to the second portion of the spreader to lock it in the open position.

In one embodiment, the climbing wall panel includes a cleat releasably engaged with a corresponding cleat on the self-supporting frame to releasably secure the two together.

The climbing wall panel has a lower edge that is preferably spaced apart from a support surface when the climbing wall panel is releasably joined to the first side to provide a foot space, so that the panel does not pinch the assembler's feet or damage a floor surface during installation of the climbing panel. The self-supporting frame defines a frame width, and preferably the climbing wall panel extends laterally outwardly beyond the frame width and includes a support surface-engaging foot for added stability.

The stowable climbing wall can further include: a second climbing wall panel releasably joined to the self-supporting frame first side and to the climbing wall panel; and a panel locking device releasably joined to the second climbing wall panel and the self-supporting frame to releasably secure the second climbing wall panel to the self-supporting frame. When multiple climbing panels are used, they can have a designated order of assembly or be able to be rearranged to enhance play value.

One or more steps can be joined to the self-supporting frame and particularly to the second side to provide a second type of climbing activity. A platform at the top of the steps can provide further play value.

A frame locking device to releasably secure the self-supporting frame in the open position preferably includes: a spreader pivotably joined to the self-supporting frame first side and the self-supporting frame second side; and a locking platform fixed to a first portion of the spreader, and releasably joined to a second portion of the spreader in the open position. The locking platform is preferably sized to provide a seat or play surface for added play value.

DETAILED DESCRIPTION OF THE DRAWINGS

Figure 1:
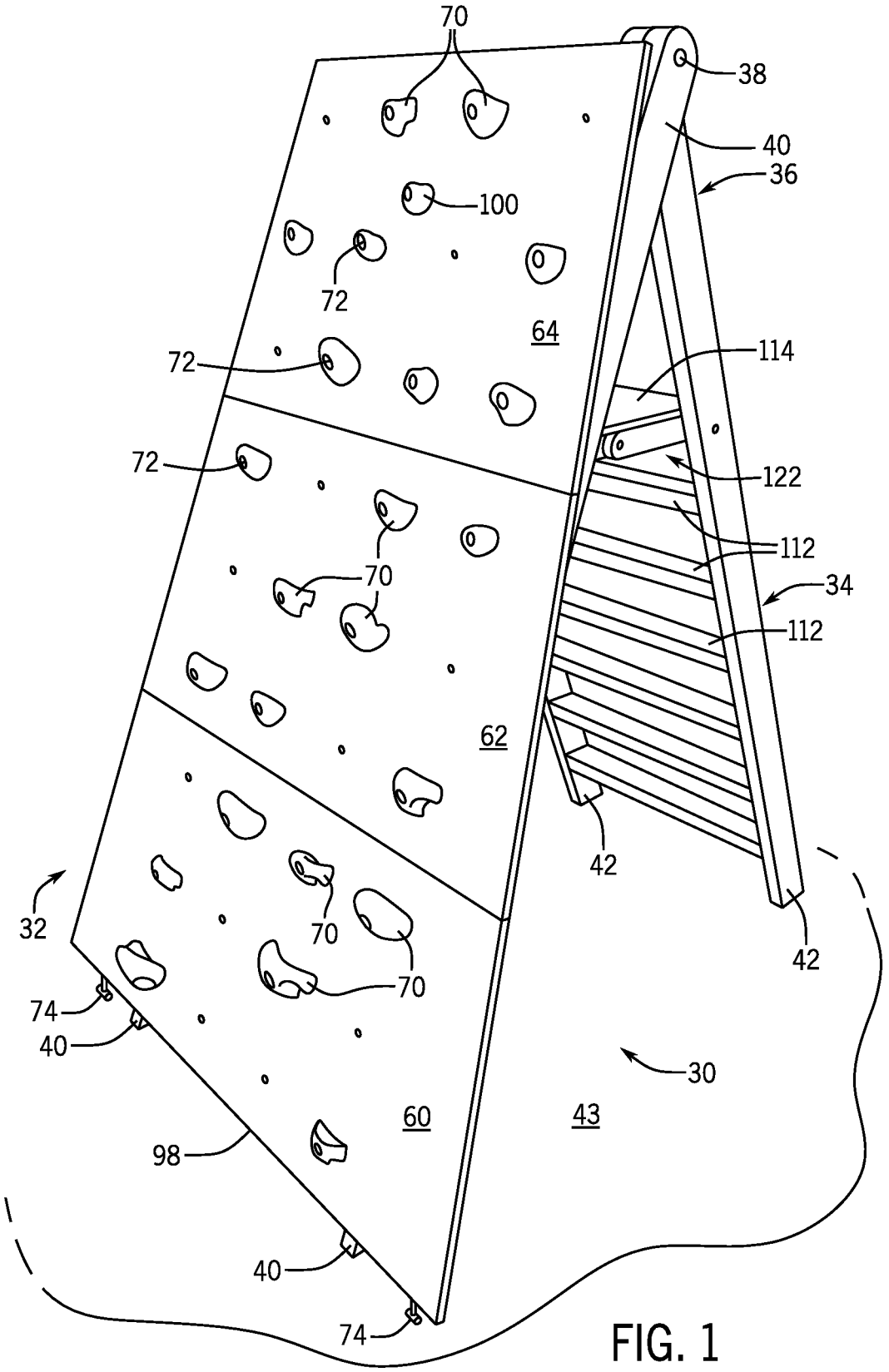
FIG. 1 is a front perspective view of a stowable climbing wall in accordance with the present invention.

In the following detailed description of the drawings, the same reference numeral will be used for the same or similar feature in each drawing.

Figure 6:
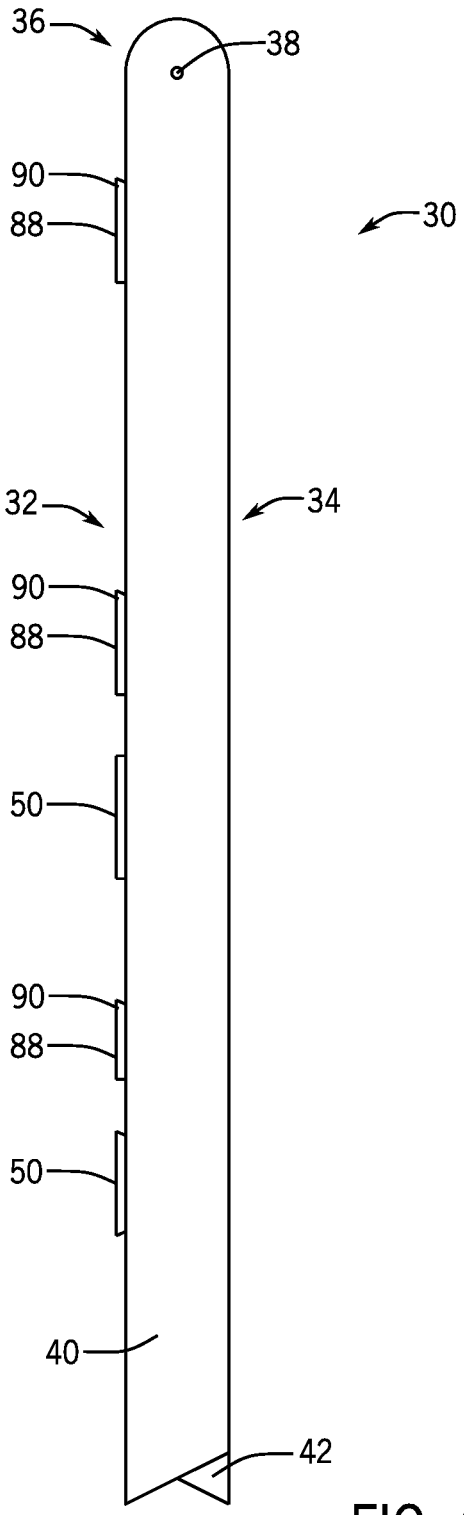
FIG. 6 is a side view of the climbing wall of FIG. 1 in a closed position.

Illustrated in FIGS. 1 through 6 is a stowable climbing wall 30 in accordance with the present invention, including: a first side 32, a second side 34, a self-supporting frame 36, and a pivot 38 joining the first side 32 and the second side 34 for movement between an open position (FIGS. 1 through 5) and a closed position (FIG. 6). In the open position, a climber can ascend and descend the climbing wall 30. In the closed position, the climbing wall 30 can be stowed in a space substantially smaller than would otherwise be possible with the climbing wall 30 in the open position. The illustrated climbing wall 30 is especially suitable for children and inexperienced climbers, particularly because the climbing wall 30 is not vertical which requires less effort and risk than a vertical climbing wall.

The self-supporting frame 36 is illustrated as having a pair of front rails 40 and a pair of rear rails 42, and each of the front rails 40 is pivotably connected to a corresponding rear rail 42 at the pivot 38. Each of the front rails 40 and the rear rails 42 is illustrated as being a single solid unit resting on a support surface 43 and extending up to the pivot 38, but any or all of the rails 40 and 42 could be telescoping or made of multiple components, if desired, to decrease its size and the amount of storage space necessary to stow the climbing wall 30. Further, with extendable frame components, a taller climbing wall 30 is achievable. The self-supporting frame 36 is considered self-supporting because it stands independently of external supports, such as walls or other supporting structures. A two-sided A-frame structure is depicted in the drawings, but other arrangements having three, four, or more sides can be used.

It is also possible that the rails 40 and 42 do not rest directly on the support surface and instead include feet or other components that support the rails 40 and 42 above the support surface. Further, any or all of the rails 40 and 42 could extend only part of the way up the climbing wall 30 or be connected to a corresponding element in another manner.

The pivot 38 is illustrated as a nut and bolt combination for each pair of front and rear rails 40/42, but the pivot 38 can be any other type including a rod extending the full width of the self-supporting frame 36, for example. The pivot 38 can also be permanently or releasably engaged with the rails 40/42.

The pivot 38 provides a reliable connection between the first side 32 and the second side 34 when in the open position, and allows the self-supporting frame 36 to pivot into the closed position (FIG. 5) for stowage. Preferably, the various components are sized, spaced, and connected to one another so that when in the closed position (FIG. 6), the self-supporting frame 36 occupies as little space as possible by reducing its footprint. In the illustrated embodiment, the rear rails 42 are spaced and positioned inside the front rails 40, so that the rear rails 42 pivot into coplanar alignment with the front rails 40, when in the closed position. In this manner, the self-supporting frame 36 preferably moves from a three-dimensional shape in the open position to a two-dimensional shape in the closed position. The other components described below are also sized and disposed to avoid interference with the rear rails 42 closing into the front rails 40.

In the open position, the first side 32 and the second side 34 are preferably inclined relative to the panel 43, but they could be at other angles. Preferably, the first side 32 and the second side 34 support one another to provide overall stability for the climbing wall 30. The illustrated embodiment is intended for younger or inexperienced climbers, so the sides are inclined at a fixed angle of about 20° from vertical. In alternate embodiments, the angle of the first side 32 and/or the second side 34, could be varied by adjusting the self-supporting frame 36 or providing a climbing wall panel support or adjustment device that can be used to vary the angle of any portion or all of the climbing surface.

In the illustrated embodiments, the front rails 40 are spaced apart laterally to provide stability for the self-supporting frame 36. Stabilizers 50 (FIGS. 2, and 4 through 8) are joined to each of the front rails 40 to provide further stability against racking and warping. The stabilizers 50 are preferably joined to the front rails 40 permanently and rigidly, but they could be releasably connected to the front rails 40 or connected to other parts of the self-supporting frame 36 to add stability. With removable stabilizers, the self-supporting frame 36 can be reduced to an even smaller size for stowage.

The first side 32 of the climbing wall 30 preferably includes a first climbing wall panel 60, a second climbing wall panel 62, and a third climbing wall panel 64, all releasably joined to the self-supporting frame 36, so that the climbing wall panels 60, 62, 64 can be removed for stowage, to reduce weight and volume of the climbing wall 30 in the closed position.

Three climbing wall panels 60, 62, and 64 are preferred for convenience of stowage and assembly of the climbing wall 30 in the illustrated embodiment, but only one panel is necessary, and any convenient number of climbing wall panels can be used to provide a climbing surface, especially as the size of the climbing wall 30 increases. Further, the climbing wall panels 60, 62, and 64 are illustrated as flat and solid, but other panel types and shapes can be used, including open grids or a wire mesh, as examples. The illustrated flat climbing wall panels 60, 62, and 64 could also define curved or faceted surfaces, simulated rock or other natural surfaces, or combinations of various surfaces. The climbing wall panels 60, 62, and 64 are preferably supported along their full combined height by the self-supporting frame 36, but one or more panels could extend above the self-supporting frame 36, if desired. Further, multiple panels can be used in place of any of the panels in the illustrated embodiment. The panels 60, 62, 64 are illustrated as having a preferred arrangement from top to bottom, but to vary the climbing experience, the panels 60, 62, 64 could be rearranged with one another or one or two panels could be omitted.

As best illustrated in FIGS. 1, 3, 4, and 7, each climbing wall panel 60, 62, 64 is preferably provided with connectors 68 for joining a number of climbing holds 70. If the panels 60, 62, 64 are made of plywood, for example, the connectors 68 are preferably threaded T-nuts (see FIG. 7) and the climbing holds 70 are preferably of standard construction releasably joined to corresponding connectors 68 in a standard fashion using a bolt 72 disposed in a recess and extending through the climbing hold 70 and threaded into the T-nut connector 68. In this manner, the climbing holds 72 can be removed and rearranged on the climbing wall panels 60, 62, 64.

Figure 3:
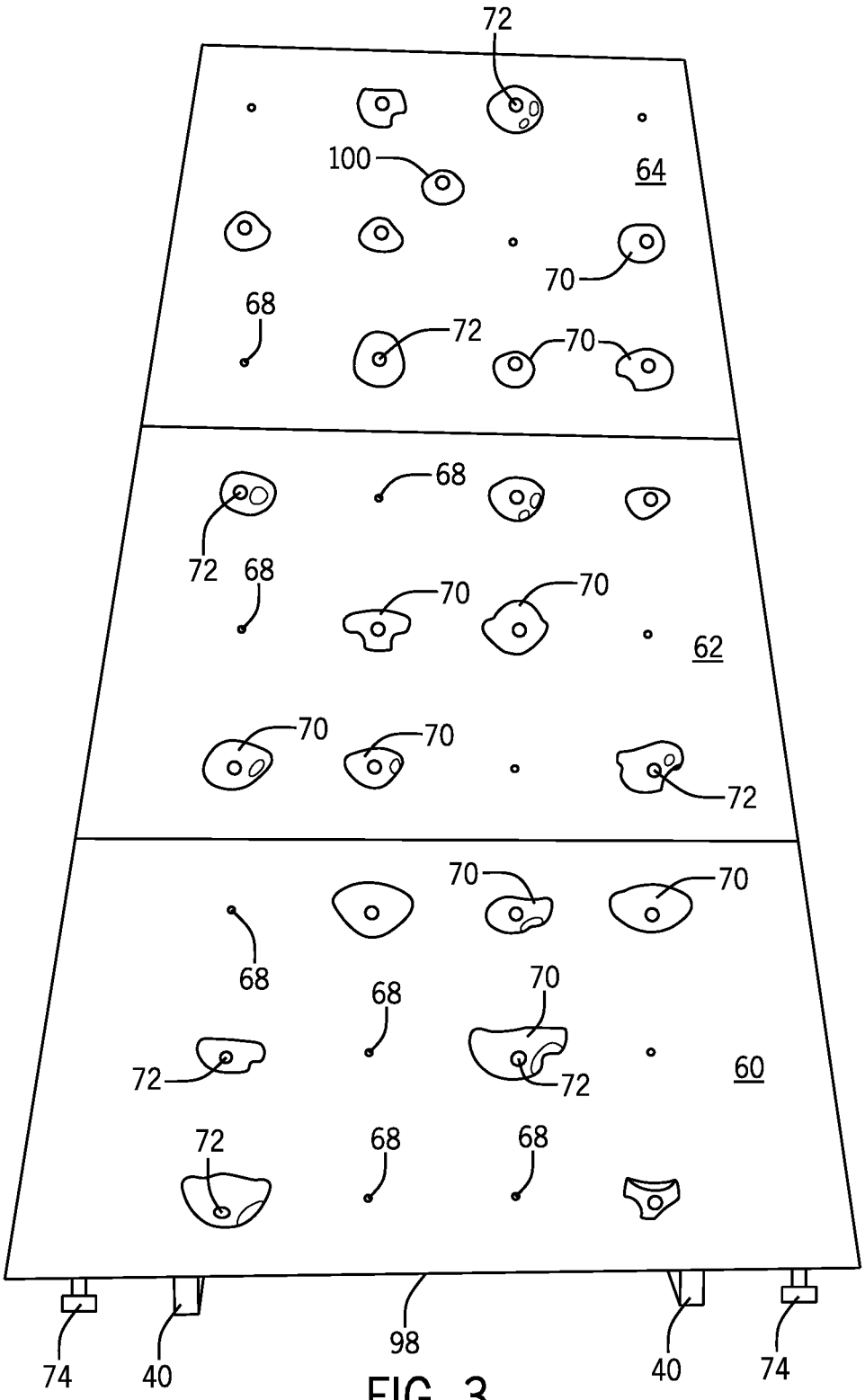
FIG. 3 is a front view of the climbing wall of FIG. 1.

As best seen in FIG. 3, the illustrated embodiments of the climbing wall panels 60, 62, 64 are preferably tapered from a relatively wide dimension at the bottom to a relatively narrow dimension at the top. This tapered shape exaggerates an appearance of height. Further, the lowest corners of the first climbing wall panel 60 preferably extend laterally outwardly from the self-supporting frame 36 and include corners or panel feet 74 to engage the support surface 43 and provide enhanced lateral stability. Preferably, the panel feet 74 are adjustable to engage uneven surfaces and are made of any suitable material for engaging the support surface 43, including resilient pads, for example.

Also preferably, all of the connectors 68 are disposed on the climbing wall panels 60, 62, 64 at locations that are within the width of the self-supporting frame 36, so that all loads from the climbing holds 70 are applied within the width of the self-supporting frame 36 (between the rails 40), as opposed to locations outside the width of the self-supporting frame 36, which would tend to tilt the climbing wall 30 or otherwise require a counterweight to maintain stability. The panel corners or feet 74 also counteract these tipping forces.

Figure 8:
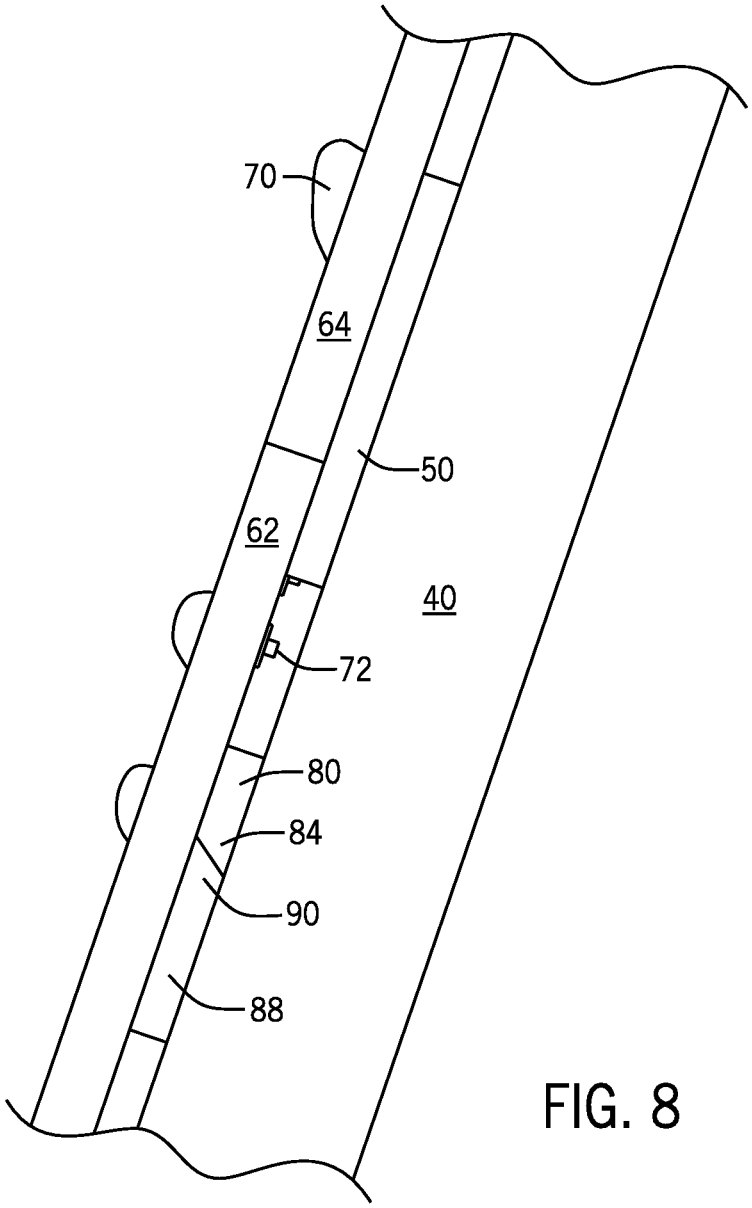
FIG. 8 is a partial side view of the climbing wall in an open position.
Figure 9:
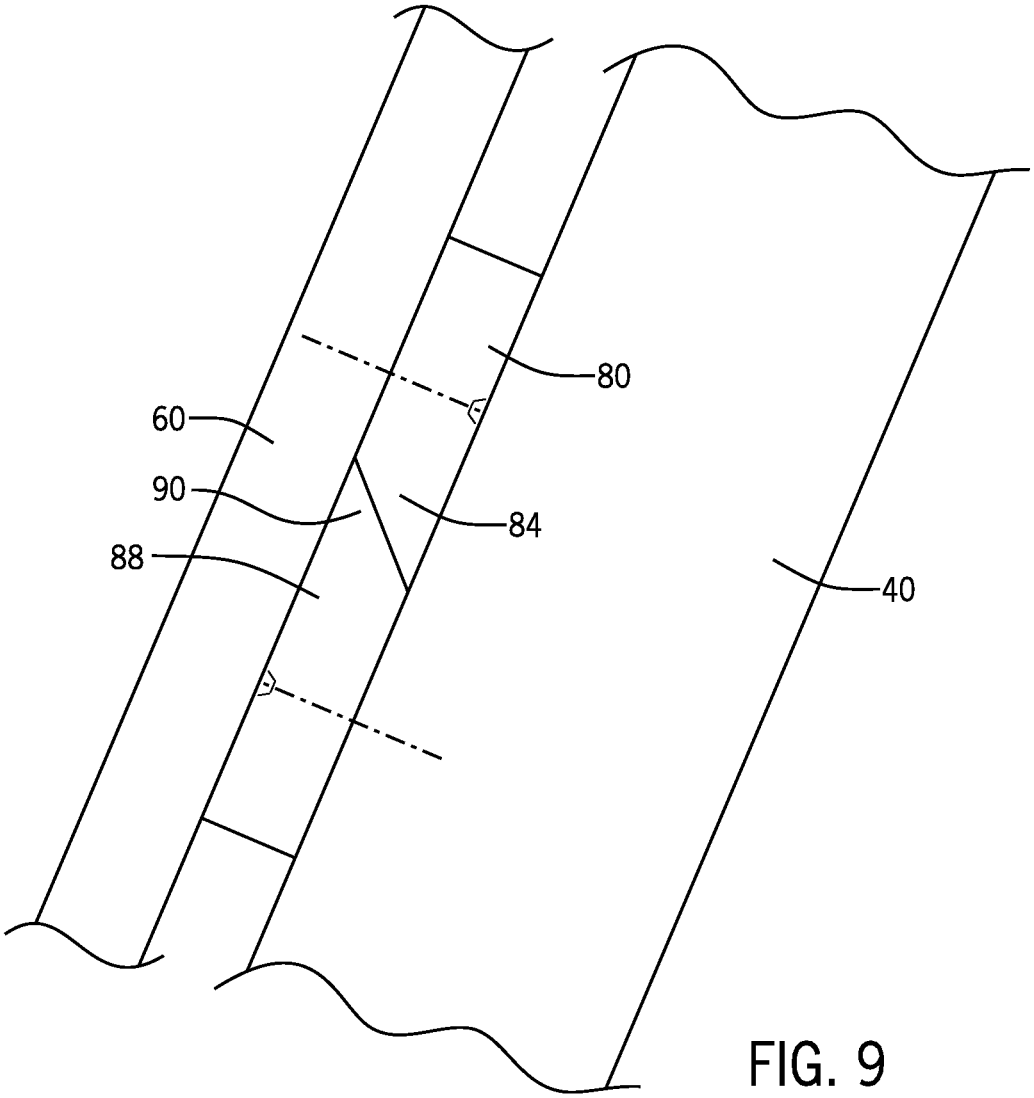
FIG. 9 is a partial side view of a climbing wall panel joined to a self-supporting frame, in accordance with the present invention.

As stated above, the climbing wall panels 60, 62, 64 are releasably joined to the self-supporting frame 36, and the connection can be made in any suitable manner. Preferably, and as illustrated in FIGS. 8 and 9, the climbing wall panels 60, 62, 64 each include a panel cleat 80 joined to its rear side 83 (the side opposite the climbing holds 70). The panel cleats 80 extend laterally across at least a portion of a respective climbing wall panel 60, 62, 64 and define a downwardly extending hook portion 84, as seen in FIGS. 8 and 9.

Mounted on the self-supporting frame 36 first side 32 are frame cleats 88 that preferably span between the rails 40, and each cleat 88 has an upwardly extending hook portion 90 sized and disposed to mate with a corresponding downwardly extending hook portion 84 on a panel cleat 80. The illustrated embodiment is sometimes referred to as a French cleat, and is a preferred arrangement because the tight and uniform engagement between cleats 80 and 88 provides a reliable connection, structural rigidity, and provides overall stability for the self-supporting frame 36. Nonetheless, other releasable connections can be used to secure the climbing panels 60, 62, 64 to the self-supporting frame 36. Preferably, as seen in FIGS. 1 through 5, the panel cleats 80 and the frame cleats 88 are disposed so that the installed climbing wall panels 60, 62, 64 define a continuous edge engagement without pinch points.

Figure 10:
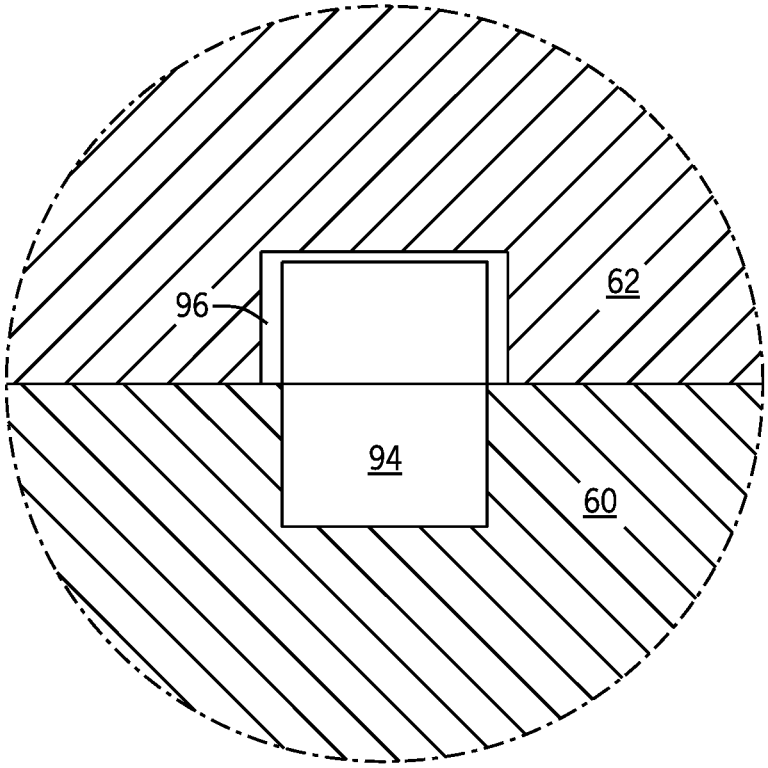
FIG. 10 is an isolated cross-sectional view of a panel alignment device in accordance with the present invention.

Further, to maintain coplanar alignment of the panels relative to one another and additional stability of the climbing wall 30 self-supporting frame 36, alignment tabs 94 (FIG. 10) are preferably used to engage and align adjacent climbing wall panels 60, 62, 64. In a preferred embodiment, the alignment tabs 94 are secured to a lower climbing wall panel while the climbing wall panel immediately above defines alignment tab recesses 96 for receiving a corresponding alignment tab 94. Preferably, the alignment tab recesses 96 are slightly wider than the corresponding alignment tab 94, so that exact lateral alignment of panels during assembly is not required to maintain the climbing wall panels 60, 62, 64 in substantially the same plane. At least one alignment tab 94 is preferred, and two or more alignment tabs 94 are more preferred. The arrangement of tabs 94 and recesses 96 could also be reversed. Other alignment devices can also be used, including tongue-in-groove panel edges, pins, magnets, and other releasable connectors.

With the above-described arrangement, the climbing wall panels 60, 62, 64 are assembled to the self-supporting frame 36 using a preferred method of: positioning the first climbing wall panel 60 against the self-supporting frame 36 with its panel cleat 80 above its corresponding frame cleat 88 and lowering the panel down to releasably engage the panel cleat 80 with the frame cleat 88.

Further, once the first (lowest) climbing wall panel 60 is in place, the above method is essentially repeated so that the second climbing wall panel 62 is positioned adjacent to the self-supporting frame 36 with its panel cleat 80 positioned above a corresponding frame cleat 88, and then lowered to engage the panel cleat 80 with the frame cleat 88, as well as insert one or more alignment tabs 94 on the first climbing wall panel 60 into a corresponding alignment tab recesses 96 in the second climbing wall panel 62 to simultaneously secure the first climbing wall panel 60 and the second climbing wall panel 62 to the self-supporting frame 36, preferably in a coplanar relationship to one another, as illustrated.

Similarly, for the third climbing wall panel 64, the third climbing wall panel 64 is positioned adjacent to the self-supporting frame 36 with its panel cleat 80 positioned above a corresponding frame cleat 88 in the next lower panel, and then lowered to engage the panel cleat 80 and the frame cleat 88, as well as insert one or more alignment tabs on the second climbing wall panel 62 into a corresponding alignment tab recesses 96 in the third climbing wall panel 64 thereby to secure the second climbing wall panel 62 and the third climbing wall panel 64 to the self-supporting frame 36, preferably in a coplanar relationship to one another, as illustrated. To disassemble the climbing wall 30, the above-stated steps are performed in the reverse order.

In this arrangement, the second climbing wall panel 62 can only be removed after the third climbing wall panel 64 is removed because the respective panel cleat 80 cannot be raised up high enough to clear the corresponding frame cleat 88. Similarly, the first climbing wall panel 60 cannot be removed until after the second climbing wall panel 62 is removed because its panel cleat 80 cannot be raised up high enough to clear the corresponding frame cleat 88. This arrangement provides security against accidental removal of the first climbing wall panel 60 and the second panel 62, until after the third climbing wall panel 64 is intentionally removed from the self-supporting frame 36.

Figure 11:
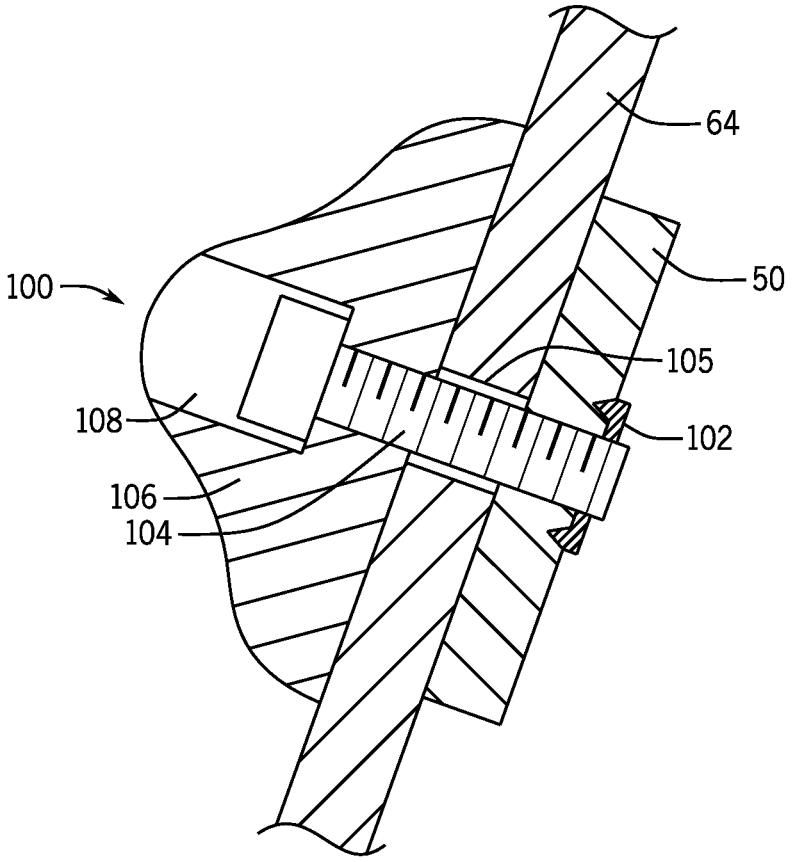
FIG. 11 is a cross-sectional view of a panel safety lock device in accordance with the present invention.

The third (or top) climbing wall panel 64 has only the weight of itself and friction between the panel cleat 80 and the frame cleat 88 to prevent the third climbing wall panel 64 from being disengaged. Thus, the present invention also preferably includes a panel locking device 100 (FIG. 11) that secures at least the third (or top) climbing wall panel 64 in place.

Preferably, the panel locking device 100 is a releasable connection that includes a T-nut connector 102 mounted on the self-supporting frame 36, such as to a stabilizer 50, as illustrated. A bolt 104 extends through the third climbing panel 64 and into the T-nut 102 to secure the third climbing wall panel 64 to the self-supporting frame 36 and prevent the third climbing wall panel 64 from becoming dislodged during use.

Also, preferably, the bolt 104 is fixed to a climbing hold 106, so that the bolt 104 extends through a slot 105 in the climbing wall panel 64, and the climbing hold 106 can be turned simultaneously with the bolt 104. By inserting the bolt 104 through the slot 105, and turning the climbing hold 106, the bolt 104 will be threaded into the T-nut 102 until it is secure and snug, but also releasable. A lateral slot 105 to align with the connector 102 is preferred over a precisely aligned hole, so that the panel locking device 100 can be used when the climbing panel 64 is laterally offset slightly.

Once the bolt 104 is securely threaded into the T-nut, the climbing hold 106 engages the third climbing wall panel 64 tightly and friction between the climbing hold 106 and the climbing wall panel 64 makes loosening the panel locking device 100 relatively difficult, especially for younger climbers. The climbing hold 106 as part of the panel locking safety device 100 allows the climbing hold 106 to appear as, and be used like, the other climbing holds 70.

A panel safety locking device 100 can be used on every climbing wall panel 60, 62, 64, but in the illustrated embodiment, the panel locking device 100 is only necessary on the third (top) climbing wall panel 64 because the first and second climbing wall panels 60 and 62 cannot be removed until the third (or top) climbing wall panel 64 is removed, as described above. Thus, the preferred panel locking device 100 is a simple way to safely secure all the climbing wall panels 60, 62, 64 to the self-supporting frame 36 and prevent inadvertent dislodgement or removal of the climbing wall panels 60, 62, 64.

Also preferably, a lower edge of the first climbing wall panel 60 remains spaced apart from the support surface 43, to allow a space or gap 98 in which an assembler's feet can be positioned while assembling the stowable climbing wall 30 without pinching or otherwise engaging the assembler's feet. This is made possible by positioning the frame cleat 88 on the self-supporting frame 36 to suspend the panel 60 at a height that is greater than the height of the panel 60. Nonetheless, the first climbing wall panel 60 could engage the support surface 43 for stability, for example.

The panels 60, 62, and 64 are depicted as being rigid and made of a suitable material such as plywood, but other materials such as plastic, metal, and even flexible fabrics could be used. Further, only climbing holds 70 are illustrated, but other climbing devices such as panel holes, pegs, high-friction surfaces, ropes, straps, and combinations of climbing devices could be used in addition to the climbing holds 70.

Figure 2:
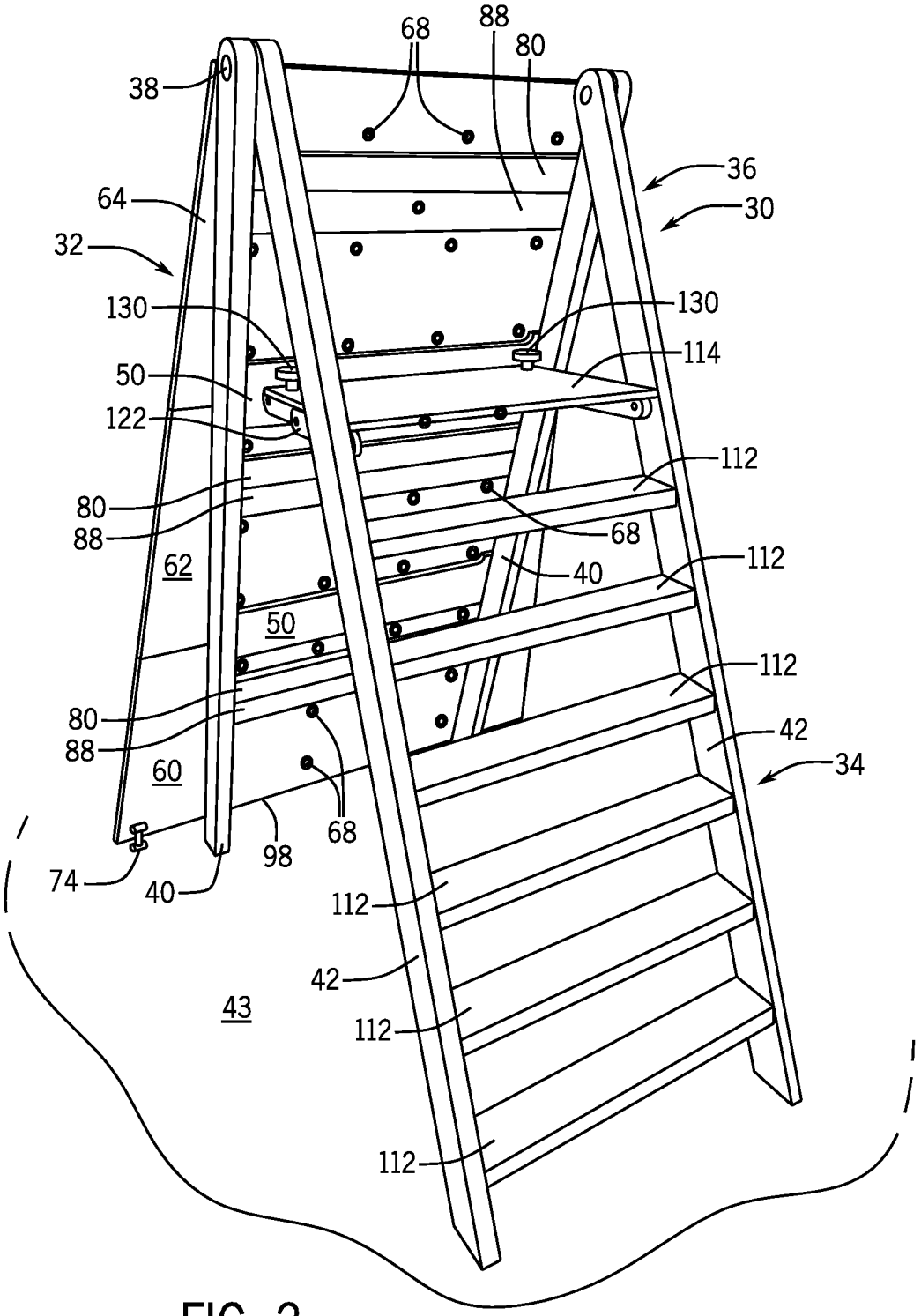
FIG. 2 is a rear perspective view of the climbing wall of FIG. 1.
Figure 4:
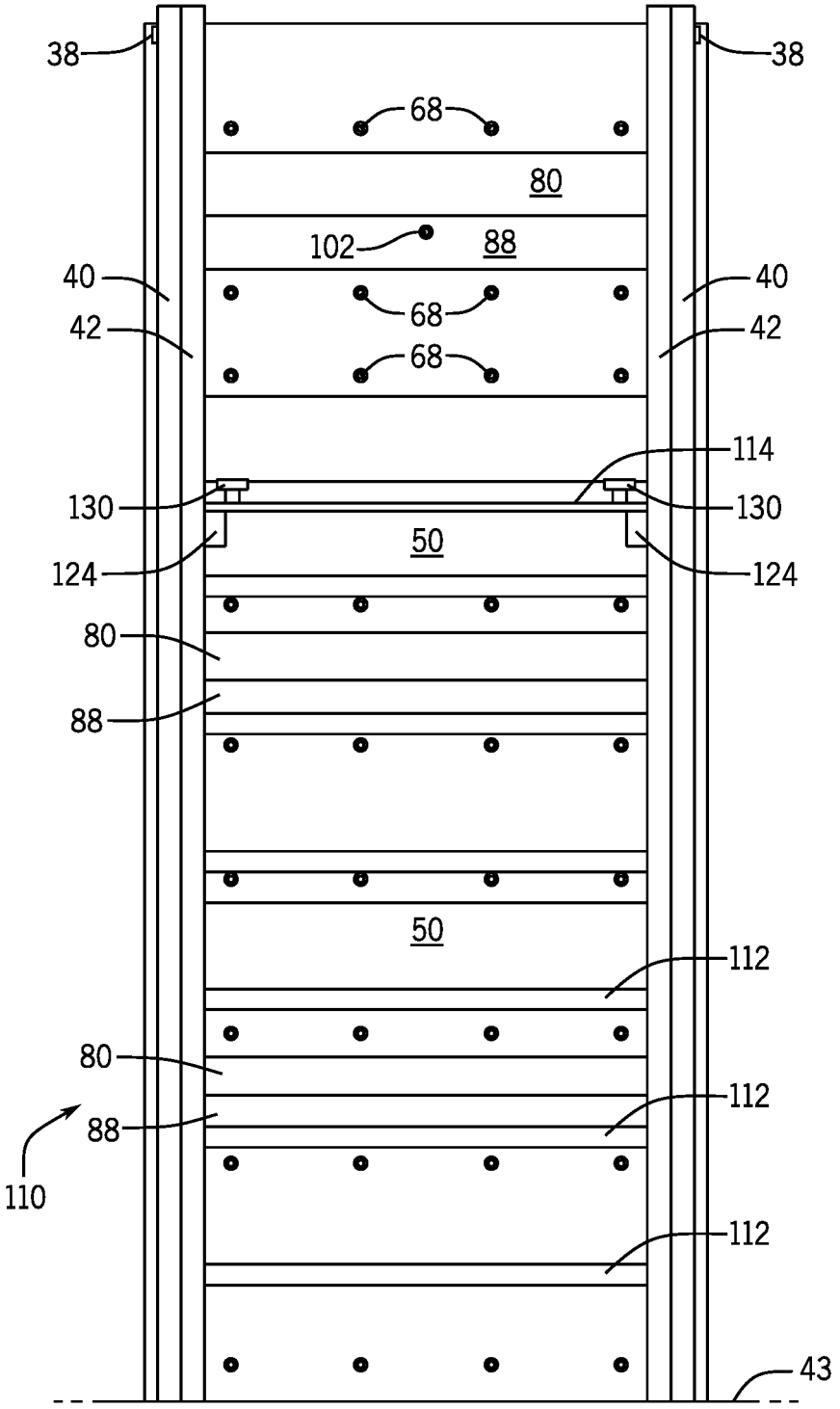
FIG. 4 is a rear view of a climbing wall of FIG. 1.
Figure 5:
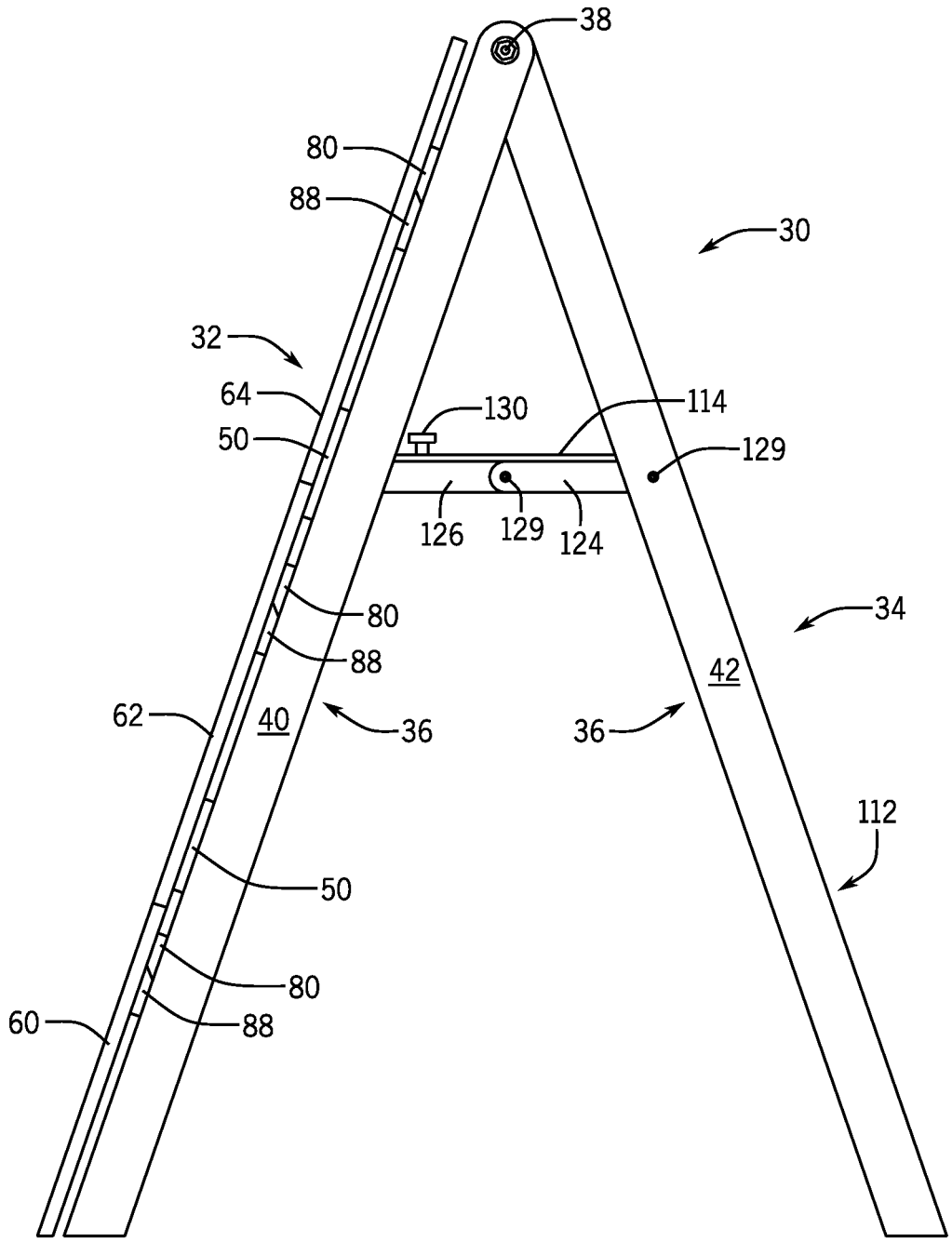
FIG. 5 is a side view of the climbing wall of FIG. 1 in an open position.

Referring now to FIGS. 2 and 4, the second side 34 of the climbing wall 30 can be identical to or similar to the first side 32, but to enhance play value in the stowable climbing wall 30, it is preferred to include different climbing components on the second side 34. In the illustrated embodiment, a ladder 110 is provided, with steps 112 leading to a platform 114. The steps 112 are joined to the rear rails 42 in any suitable manner, including screws, nails, adhesive, and mortise and tenon joinery, as examples. The ladder 110 steps 112 can be any desired shape or spacing, and they can be rigid or flexible. As stated above, other climbing devices could be included, as well.

In the illustrated embodiment, the first side 32 and the second side 34 of the self-supporting frame 36 are preferably inclined relative to the support surface 43. The weight of the stowable climbing wall 30 and friction with the support surface typically will prevent inadvertent movement of the first side 32 and the second side 34 toward the closed position (FIG. 5), but such inadvertent movement should be prevented with an appropriate mechanism or device and is preferably not left to gravity and friction. Thus, it is preferred to add a frame locking device 120 to establish an open position, maintain the self-supporting frame 36 in the open position, and prevent inadvertent movement toward the closed position.

Figure 7:
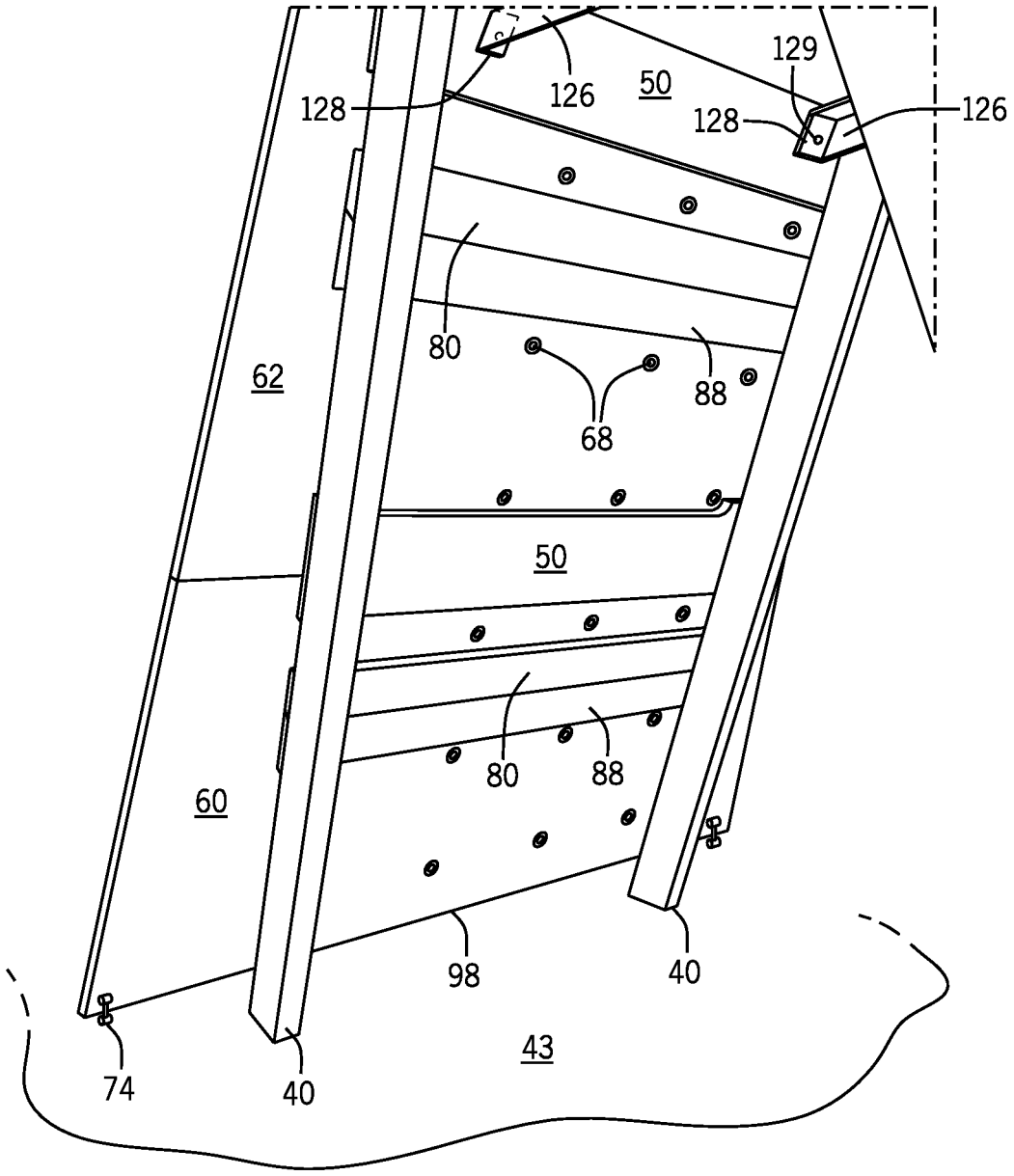
FIG. 7 is a partial rear perspective view of a first side of the climbing wall of FIG. 1.

Various types of frame locking devices 120 can be used, but the illustrated embodiment includes the spreader 122 having a pair of first links 124 and a pair of second inks 126. Each first link 124 is pivotably connected to a corresponding rear rail 42 and to a corresponding second link 126. Each second link 126 is pivotably joined to the self-supporting frame 36, preferably a stabilizer 50, with any suitable connection, including a bracket 128, as illustrated in FIG. 7 to permit controlled folding of the spreader 122 toward a closed position (FIG. 6) and spreading toward an open position (FIG. 5), when desired. The first links 124 and the second links 126 are joined using pins 129, that can be of any suitable type, including bolts and sleeve nuts or cap nuts, for example.

Figure 12:
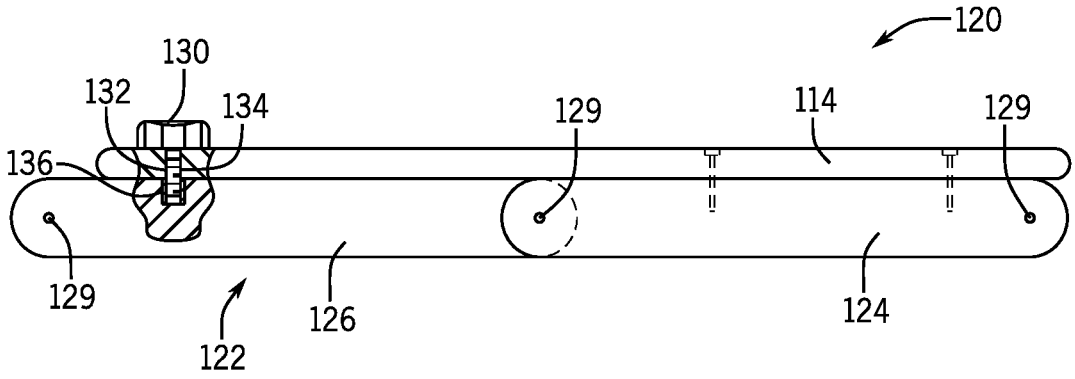
FIG. 12 is an isolated side view of a safety spreader mechanism in an open position for a stowable climbing wall, in accordance with the present invention.
Figure 13:
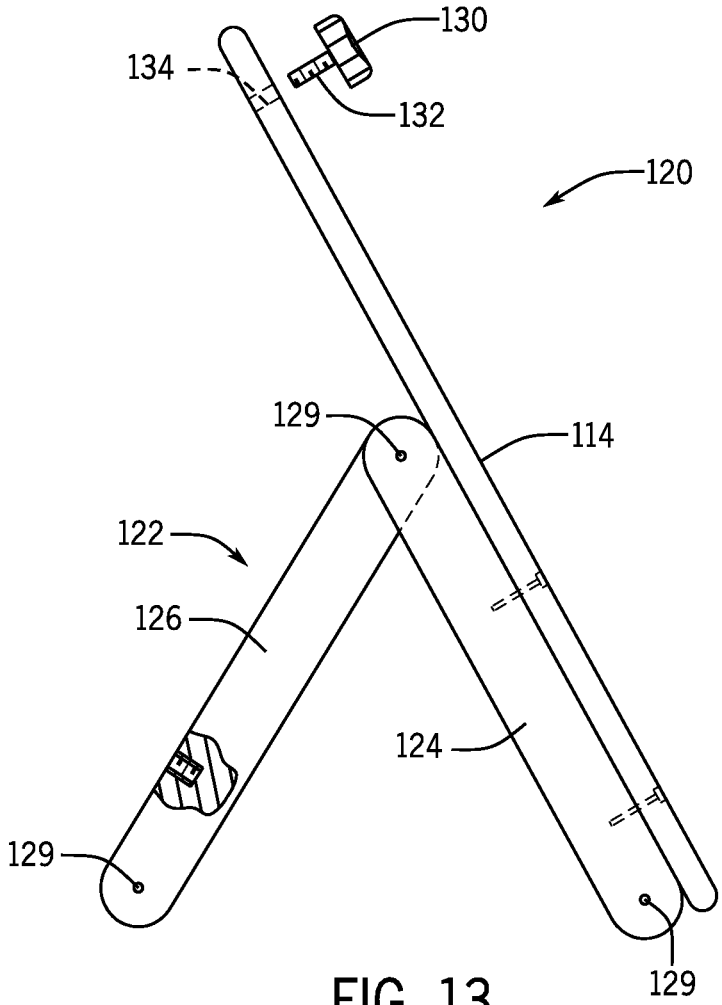
FIG. 13 is an isolated side view of the safety spreader mechanism of FIG. 11 in a partially closed position.
Figure 14:
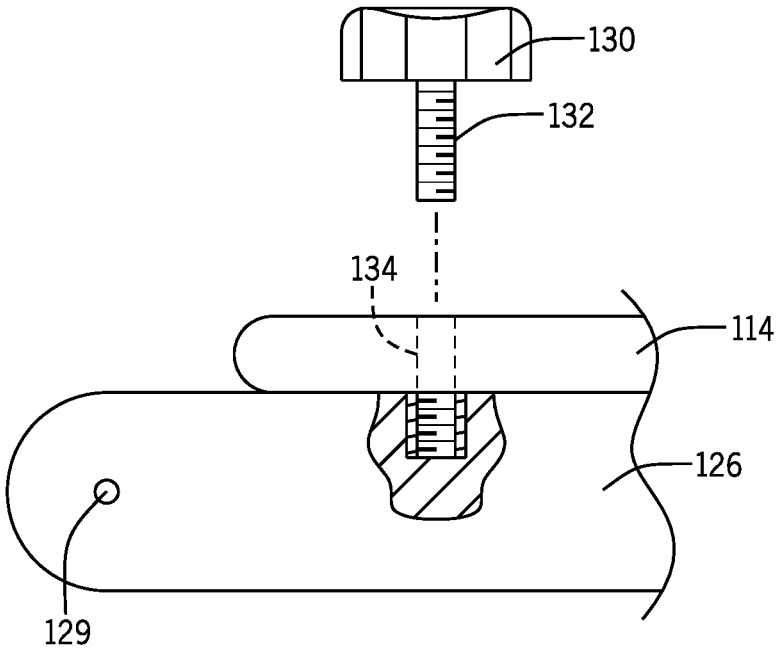
FIG. 14 is a partial exploded side view of a frame locking device, in accordance with the present invention.

As best seen in FIGS. 12 and 13, the frame locking device 120 incorporates the platform 114 fixed to each of the first links 124 and releasably joined to one or both of the second links 126 in the open position. To releasably secure the platform 114 to each of the second links 126, a knob 130 with a threaded post 132 is inserted through a corresponding hole 134 in the platform 114 and threaded into a nut or threaded insert 136 (or other connector) in the second link 126, as seen in FIG. 14. As part of the assembly process, the knobs 130 can be tightened down snugly to prevent removal by a younger climber. Once the knobs 130 are secured to the second links 126, the spreader 122 cannot fold toward a closed position because the platform 114 rigidly maintains the spreader in the open position (FIG. 3) to prevent such folding. The knobs 130 can be replaced with other devices or omitted altogether. To disassemble the climbing wall 30, the knobs 130 can be removed and the above-described steps reversed.

The spreader 122 position and dimension define a corresponding spacing between the front 32 and the back 34 of the climbing wall 30. An adjustable spreader could be used to allow the climbing wall 30 to define various climbing angles and further enhance the play value of the climbing wall 30.

Preferably, and as illustrated, the platform 114 is sized to define a seat and/or play area accessible from one or both sides of the climbing wall 30. Various activities can be provided for a user positioned on the platform 114.

To assemble the stowable climbing wall 30, the self-supporting frame 36 is spread so that the spreader 122 reaches the open position (FIG. 12). One or both of the knobs 130 are then used to secure the platform 114 to the spreader 122 second links 126 to releasably secure the spreader 122 and the self-supporting frame 36 in the open position (FIGS. 1 and 2). Next, the climbing wall panels 60, 62, 64 are installed sequentially, as described above, and secured with the panel locking device 100. Thus, in the illustrated embodiment, only two safety devices 100 and 120 are needed to provide a safe and stable stowable climbing wall 30. Other safety devices could be used, as well. The stowable climbing wall 30 is readily disassembled by reversing these steps and stowing the individual parts in any suitable location. When disassembled, the climbing wall 30 parts occupy much less space, and are easy to reassemble. Preferably, the storage space is relatively two-dimensional relative to the three-dimensional space the climbing wall 30 occupies when assembled.

The materials used in the illustrated embodiment are wood and plywood, and metal brackets, pins, and pivots are used to secure the parts. Other materials, shapes, orientations, and sizes can be used in accordance with the present invention. The present invention can be used in homes, playgrounds, schools, activity centers and elsewhere, particularly when the climbers will be children. Nonetheless, the stowable climbing wall 30 could be sized for use by taller and heavier climbers and be sized for transporting between training areas, including outdoors for practice and warm ups prior to actual rock climbing activities.

The foregoing detailed description of the drawings is provided for understanding the invention, as seen in the illustrated embodiments. No unnecessary limitations therefrom should be read into the following claims.

The invention claimed is:

1. A stowable climbing wall comprising:

a self-supporting frame having a first side and second side pivotably joined to the first side at an upper pivot, and the first side is moveable relative to the second side between an open position and a closed position;

a climbing wall panel releasably joined to the first side;

a second climbing wall panel releasably joined to the self-supporting frame first side and to the climbing wall panel, and including a cleat releasably engaged with a corresponding cleat joined to the self-supporting frame first side;

a panel lock releasably joined to the second climbing wall panel and the self-supporting frame to releasably secure the second climbing wall panel cleat to the self-supporting frame first side cleat;

a climbing surface joined to the second side; and a platform operatively engaged with the self-supporting frame.

2. The stowable climbing wall of claim 1, wherein the self-supporting frame first side includes a pair of spaced apart rails to which the climbing wall panel is releasably joined.

3. The stowable climbing wall of claim 1, and further comprising wherein the first side comprises:

a pair of spaced apart rails that support the full height of the climbing wall panel.

4. The stowable climbing wall of claim 1, wherein:

the self-supporting frame first side includes:

a first side rail; and the self-supporting frame second side includes:

a second side rail pivotably joined to the first side rail by the upper pivot.

5. The stowable climbing wall of claim 1, wherein:

the climbing surface comprises:

a plurality of vertically spaced apart steps.

6. The stowable climbing wall of claim 1, wherein:

the self-supporting frame first side includes:

a pair of spaced apart first side rails; and the self-supporting frame second side includes:

a pair of second side rails.

7. The stowable climbing wall of claim 1, and further comprising:

a frame lock to releasably maintain the self-supporting frame in the open position.

8. The stowable climbing wall of claim 1, and further comprising:

a frame locking device lock releasably joined to the self-supporting frame first side and the self-supporting frame second side in the open position, wherein the frame lock includes:

a spreader pivotably joined to the self-supporting frame first side and the self-supporting frame second side, and operatively joined to the platform.

9. The stowable climbing wall of claim 1, wherein the climbing wall panel includes a cleat releasably engaged with a corresponding cleat joined to the self-supporting frame first side.

10. The stowable climbing wall of claim 1, wherein the climbing wall panel includes:

a lower edge that is spaced apart from a support surface when the climbing wall panel is releasably joined to the first side.

11. The stowable climbing wall of claim 1, wherein the self-supporting frame defines a frame width and the climbing wall panel extends laterally outwardly beyond the frame width, and includes a support surface-engaging portion.

12. The stowable climbing wall of claim 1, and wherein the climbing surface comprises:

a step.

13. The stowable climbing wall of claim 1, and wherein the:

climbing surface joined to the self-supporting frame second side comprises:

a plurality of steps.

14. A stowable climbing wall comprising:

a self-supporting frame having a first side and second side pivotably joined to the first side at an upper pivot, and the first side is moveable relative to the second side between an open position and a closed position;

a climbing wall panel releasably joined to the first side;

a climbing surface joined to the second side;

a platform operatively engaged with the self-supporting frame; and a frame lock releasably joined to the self-supporting frame first side and the self-supporting frame second side in the open position, wherein the frame lock includes:

a spreader pivotably joined to the self-supporting frame first side and the self-supporting frame second side; and wherein the platform is:

a locking platform fixed to a first portion of the spreader, and releasably joined to a second portion of the spreader, and a connector releasably joining the locking platform to the second portion of the spreader.

15. The stowable climbing wall of claim 14, and further comprising:

a second climbing wall panel joined to the first side.

16. The stowable climbing wall of claim 14, and further comprising:

a panel lock releasably joined to the climbing wall panel and the self-supporting frame.

17. The stowable climbing wall of claim 14, and further comprising: a second climbing wall panel releasably joined to the self-supporting frame first side and to the climbing wall panel.

18. A stowable climbing wall comprising:

a self-supporting frame having a first side and second side pivotably joined to the first side at an upper pivot, and the first side is moveable relative to the second side between an open position and a closed position;

a climbing wall panel releasably joined to the first side;

a climbing surface joined to the second side;

a platform operatively engaged with the self-supporting frame;

a second climbing wall panel releasably joined to the self-supporting frame first side and to the climbing wall panel, and including a cleat releasably engaged with a corresponding cleat joined to the self-supporting frame first side; and a panel lock releasably joined to the second climbing wall panel and the self-supporting frame to releasably secure the second climbing wall panel cleat to the self-supporting frame first side cleat, and to releasably secure the second climbing wall panel to the climbing wall panel.

19. A stowable climbing wall comprising:

a self-supporting frame having a first side and second side pivotably joined to the first side at an upper pivot, and the first side is moveable relative to the second side between an open position and a closed position;

a climbing wall panel releasably joined to the first side;

a climbing surface joined to the second side;

a platform operatively engaged with the self-supporting frame;

a second climbing wall panel releasably joined to the self-supporting frame first side and to the climbing wall panel;

a frame cleat joined to the first side;

a cleat joined to the climbing wall panel and releasably joined to the frame cleat; and a panel lock releasably joined to the second climbing wall panel and the self-supporting frame to releasably secure the climbing wall panel cleat to the frame cleat.

20. The stowable climbing wall of claim 19, and further comprising:

a frame lock releasably secured to the self-supporting frame first side and the self-supporting frame second side in the open position.

21. The stowable climbing wall of claim 19, and further comprising:

a frame lock releasably secured to the self-supporting frame first side and the self-supporting frame second side in the open position, wherein the frame lock includes:

a spreader pivotably joined to the self-supporting frame first side and the self-supporting frame second side; and a lock operatively joined to the platform and a first portion of the spreader, and releasably joined to a second portion of the spreader in the open position.

* * * * *